US006998955B2

(12) United States Patent
Ballew et al.

(10) Patent No.: US 6,998,955 B2
(45) Date of Patent: Feb. 14, 2006

(54) VIRTUAL ELECTRONIC REMOTE CONTROL DEVICE

(76) Inventors: Michael A. Ballew, 181 Mt. Lebanon Church Rd., Greer, SC (US) 29651; Larry D. Mason, 201 Eagles Nest Ct., Taylors, SC (US) 29687

( * ) Notice: Subject to any disclaimer, the term of this patent is extended or adjusted under 35 U.S.C. 154(b) by 375 days.

(21) Appl. No.: 10/215,423

(22) Filed: Aug. 9, 2002

(65) Prior Publication Data

US 2004/0036624 A1 Feb. 26, 2004

(51) Int. Cl.
*G05B 19/00* (2006.01)

(52) U.S. Cl. ..... 340/5.1; 340/5.5; 340/5.61; 340/5.64; 700/9; 700/11; 700/19; 700/20; 709/230; 370/467

(58) Field of Classification Search ..... 700/9, 700/11, 17, 20, 19; 340/825, 5.1, 5.5, 5.6, 340/5.61, 5.64; 710/8, 11; 709/230; 370/465–467
See application file for complete search history.

(56) References Cited

U.S. PATENT DOCUMENTS

| | | | | |
|---|---|---|---|---|
| 4,918,439 | A | 4/1990 | Wozniak et al. | 340/825.69 |
| 5,282,028 | A * | 1/1994 | Johnson et al. | 725/139 |
| 5,455,570 | A * | 10/1995 | Cook et al. | 340/825.22 |
| 5,600,311 | A | 2/1997 | Rice et al. | 340/825.19 |
| 5,717,737 | A * | 2/1998 | Doviak et al. | 455/403 |
| H1772 | H * | 1/1999 | Akahane | 340/825.22 |
| 5,877,957 | A | 3/1999 | Bennett | 700/86 |
| 5,922,047 | A | 7/1999 | Newlin et al. | 709/217 |
| 6,112,127 | A | 8/2000 | Bennett | 700/86 |
| 6,172,609 | B1 * | 1/2001 | Lu et al. | 340/572.4 |
| 6,192,282 | B1 * | 2/2001 | Smith et al. | 700/19 |
| 6,198,408 | B1 | 3/2001 | Cohen | 340/825.69 |
| 6,218,931 | B1 | 4/2001 | Asghar et al. | 340/310.02 |
| 6,229,433 | B1 | 5/2001 | Rye et al. | 340/310.01 |
| 6,603,394 | B1 * | 8/2003 | Raichle et al. | 340/438 |
| 6,622,925 | B1 * | 9/2003 | Carner et al. | 236/46 R |
| 6,711,629 | B1 * | 3/2004 | Christensen et al. | 710/8 |
| 6,724,339 | B1 * | 4/2004 | Conway et al. | 341/176 |
| 6,744,352 | B1 * | 6/2004 | Lesesky et al. | 340/431 |
| 6,761,470 | B1 * | 7/2004 | Sid | 362/233 |
| 6,839,613 | B1 * | 1/2005 | McCarthy et al. | 700/287 |
| 2001/0019367 | A1 * | 9/2001 | Walton et al. | |
| 2002/0027504 | A1 * | 3/2002 | Davis et al. | 340/540 |
| 2003/0002073 | A1 * | 1/2003 | Berkema et al. | 358/1.15 |
| 2003/0195969 | A1 * | 10/2003 | Neuman | |
| 2004/0029613 | A1 * | 2/2004 | Kitazumi et al. | 455/557 |

* cited by examiner

*Primary Examiner*—Anthony Knight
*Assistant Examiner*—Crystal J Barnes
(74) *Attorney, Agent, or Firm*—Douglas W. Kim; McNair Law Firm, P.A.

(57) ABSTRACT

This invention is directed to a system and method for actuating an electronic device having a first protocol with a command device having a second protocol so as to actuate such consumer device regardless of differences in protocol. An electronic device may be remote controlled through a infrared protocol for such functions as being turned on, turned off, or other functions related to the specific device. As such, command devices, such as remote controls are highly specialized and dependent upon the protocol of the electronic device for actuating such device. This invention allows a command device of any protocol to actuate a electronic device of any other protocol through associating the input signal to the electronic device with an output signal from the command device and converting one protocol to another with associated command.

15 Claims, 8 Drawing Sheets

VIRTUAL ELECTRONIC REMOTE CONTROL DEVICE

FIELD OF THE INVENTION

This invention is directed to a universal remote control, and more specifically, to a device for allowing any number of input devices to control any number of electronic devices in the residential, commercial, or industrial fields.

BACKGROUND OF THE INVENTION

With the increased dependence upon consumer electronics, most homes and businesses have incompatible systems controlled through many incompatible means. For example, infrared signals are used between a remote control and a stereo or television, physical wiring as well as infrared are used for activation or deactivation of alarm systems, radio frequency and physical wiring are used for doorbells, and existing electrical household wiring is used for X-10. The incompatibility of these systems, which prevents any one control or input device from operating all consumer electronic devices or even one of a differing protocol. For example, one could not play a music file from a computer by pressing the doorbell. Additionally, one cannot start a compact disc playing by flipping a light switch.

As more vendors provide more and more consumer electronic devices, the need to have a universal means for controlling such appliances becomes ever increasing. Attempts have been made to address this problem for specific protocols, but nothing exists to be able to globally control consumer electronic devices in the entire household. For example, U.S. Pat. No. 6,198,408 is directed to an apparatus for controlling electrical appliances by means of a command signal transmitted by a particular remote control transmitter. However, this reference is limited to using the specific remote controls limited to an infrared signal and specialized power adapters for merely controlling the power supply to and from the consumer electronic device. This reference does not provide for control functionality other than affecting the electrical power supplied to a particular device.

U.S. Pat. No. 6,229,433 is directed toward an appliance control system primarily based upon a protocol marketed under the trademark X-10®. This allows for the controlling of a particular electronic appliance through the electrical wiring of a home. However, this reference requires significant investment in the control units. Additionally, this invention is restricted to the X-10 protocol. The specific protocol requires data pulses or serial output bursts in order to control the specific units rather than allowing for the universal control system that would cross various protocols.

Accordingly, it is the object of this invention to provide for a universal control system able to control residential, commercial or industrial electronic devices regardless of any specific protocol.

Another object of this invention is to allow for control mechanism of one system to be able to actuate a consumer electronic device operating on another system.

SUMMARY OF THE INVENTION

The above objectives are accomplished by providing an activation device for controlling at least one electronic device responsive to a first protocol according to at least one controlling device generating an input signal having a second protocol. The device can include a housing, a computer readable medium contained within the housing, an input means contained within the housing and in communication with the computer readable medium for receiving the input signal from the at least one controlling device, an output means contained within the housing and in communication with the computer readable medium for outputting an output signal to the at least one electronic device, using the first protocol, a set of computer readable protocol instructions embodied within the computer readable medium for associating the first protocol with the second protocol, and a set of computer readable command instructions embodied within the computer readable medium. The set of computer readable instructions can include instructions for receiving an input signal having the second protocol from the at least one controlling device using the input means, generating the output signal having the first protocol to the at least one electronic device according to the input signal and the set of protocol instructions, and transmitting the output signal using the output means to the at least one electronic device so that the controlling device can actuate the at least one electronic device without the controlling device having to use the same protocol as the electronic device. The first protocol can be X-10 infrared, radio frequency or any other signal protocol. The output signal can be X-10, infrared radio frequency, or any other signal protocol. The set of protocol instructions can include instructions for identifying the at least one command device according to the input signal, identifying a key command according to the input signal, and generating the output signal according to the command device and the key command. The set of command instructions may include instructions for receiving a validation signal as to whether the output signal reached the electronic device.

The invention can include a system for controlling at least one electronic device having a first protocol according to a command device generating an input signal having a second protocol. The system can include a set of actuating information embodied within the computer readable medium representing at least one output command to the at least one electronic device, a set of command device information embodied within the computer readable medium representing at least one command device, the command device information containing at least one specific command associated with the command device and associated with the at least one output command, a set of computer readable instructions embodied within the computer readable medium for receiving an input signal from the command device, determining the at least one specific command contained within the input signal, retrieving at least one output command associated with the at least one specific command from the set of actuating information, and transmitting the at least one output command to the electronic device through the output means. The set of computer readable instructions may include instructions for formatting the at least one output command prior to transmitting the at least one output command to the at least one electronic device.

The invention can include a system for controlling at least on electronic device being responsive to a first protocol according to a command device generating an input signal having a second protocol. The system can include a computer readable medium, an input means in communication with the computer readable medium for receiving an input signal from the command device, a set of registers contained within the computer readable medium for storing register information having input signal information, output signal information, associational information for associating the input signal information with the output signal information, an output means in communication with the computer readable medium for outputting output signal information to the at least on electronic device, and a set of computer readable instructions embodied within the computer readable medium. The set of computer readable instructions are for receiving the input signal information from the command device having the second protocol through sand input means and outputting the associated output signal information through the output means to the at least one electronic device so that the electronic device can be actuated by the command device regardless of differing protocols. The set of computer readable instructions may include instructions for receiving a validation signal from the at least one electronic device as to whether the output signal information reached the at least on electronic device and formatting the output signal information prior to outputting the output signal information to the at least one electronic device.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1A:
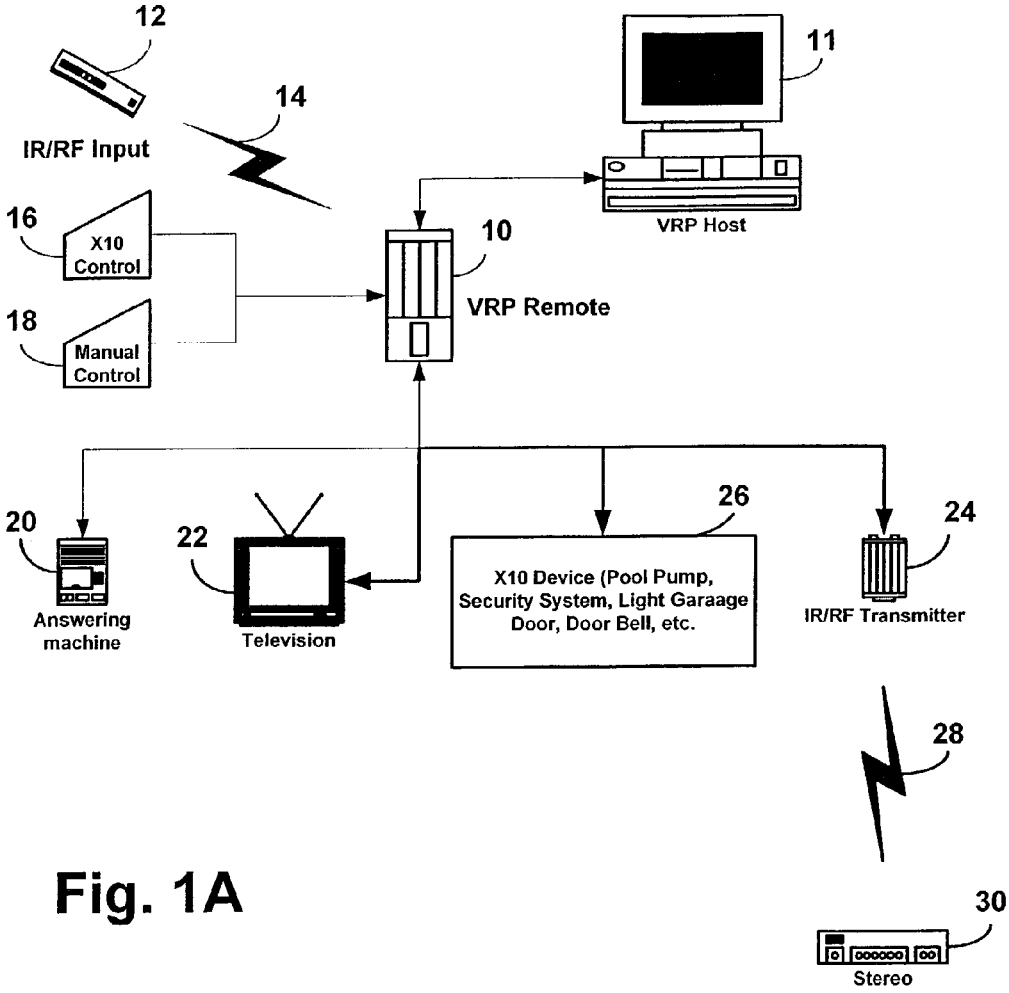
FIG. 1A is a schematic of the relationship of various components of the invention and electronic devices.

The detailed description that follows may be presented in terms of program procedures executed on the computer or network of computers. These procedural descriptions and representations are used by those skilled in the art to most effectively convey the substance of their work to others skilled in the art. The procedures herein described are generally a self-consistent sequence of steps leading to a desired result. These steps require physical manipulations of physical quantities such as electrical or magnetic signals capable of being stored, transferred, combined, compared, or otherwise manipulated. An object or module is a section of computer readable code that is designated to perform a specific task or tasks. Actual computer or executable code or computer readable code may not be contained within one file or one storage medium but may span several computers or storage mediums. The terms "server", "computer", "host" or "remote" can be hardware, software, or a combination of hardware and software that provides the functionality described herein. These terms are not to be limited to one computer or one software application.

The present invention is described below with reference to flowchart illustrations of methods, apparatus (systems), schematics, and computer program products according to the invention. It will be understood that each block of the flowchart illustrations can be implemented by computer readable instructions. These computer instructions may be loaded onto a general purpose computer, special purpose computer or other programmable data processing apparatus to produce a machine, such that the instructions which execute on the computer or other programmable data processing apparatus create means for implementing the functions specified in the flowchart block or blocks.

These computer program instructions may also be stored in a computer readable memory that can direct a computer or other programmable data processing apparatus to function in a particular manner, such that the instructions stored in the computer readable memory produce an article of manufacture including instruction means for implementing the function specified in the flowchart block or blocks. The computer program instructions may also be loaded onto a computer or other programmable apparatus to produce a computer executed process such that the instructions, when executed on the computer, or other programmable apparatus, provide steps for implementing the functions specified in the flowchart elements.

Accordingly, elements of the flowchart support combinations of means for performing the specified functions, combinations of steps for performing the specified functions and program instruction means for performing the specified functions. It will also be understood that each block of the flowchart illustrations can be implemented by special purpose hardware-based computer systems, which perform the specified functions or steps, or combinations of special purpose hardware and computer instructions.

The present invention now is described more fully hereinafter with reference to the accompanying drawings, in which the preferred embodiments of the invention is shown. This invention may, however, be embodied in many different forms and should not be construed as limited to the embodiments set forth herein, rather, these embodiments are provided so that this disclosure will be thorough and complete, and will fully convey the scope of the invention to those skilled in the art.

Referring now to FIG. 1A, a VRP remote 10 is shown and can receive input from an infrared (IR) or radio frequency (RF) input device 12 through broadcast signal 14. Additionally, VRP remote 10 can receive input from an X-10 device 16 or from a manual device 18, such as a traditional light switch. Upon receiving such inputs, the VRP remote can transmit an output signal to a plurality of devices according to the input signal received. For example, VRP remote 10 can transmit signals to an answering machine 20, a television set 22, an IR/RF transmitter 24 or an X-10 device such as a pool pump, or to security systems, lights, garage doors, doorbells, or other consumer electronic devices 26. Therefore, VRP remote allows a plurality of consumer control devices, 20 through 26, to be operated according to any number of input devices 12 through 18. It should be noted that IR/RF transmitter 24, according to receiving a command from the VRP remote, can transmit an output signal 28 to a consumer electronic device such as a stereo 30 so that the stereo is operated according to the input signal.

Figure 1B:
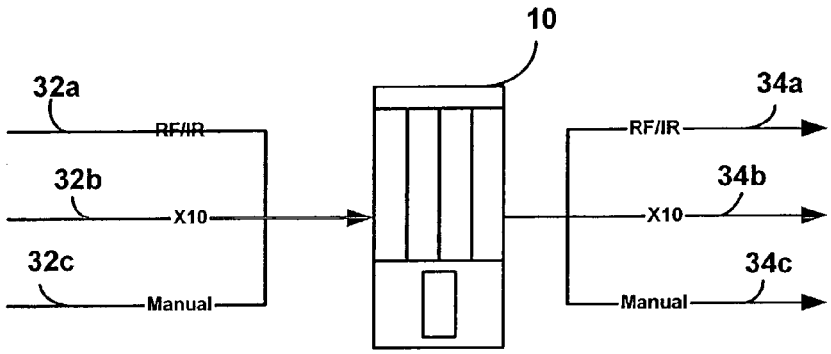
FIG. 1B is a schematic illustrating data flow for this invention.

Referring to FIG. 1B, VRP remote 10 is shown to be able to receive any number of input formats such as IR/RF format 32*a*, X-10 format 32*b* or manual format 32*c* and, according to such input, output IR/RF output signal 34*a* and X-10 output signal 34*b* or a manual switch signal output 34*c*.

Therefore, a homeowner is able to control a plurality of consumer electronic devices regardless of whether they share a common input controller or input format protocol. By way of specific example, an infrared radio remote control can be used to turn on a pool pump, security system, light, garage door, doorbell, or other consumer electronic.

Figure 2:
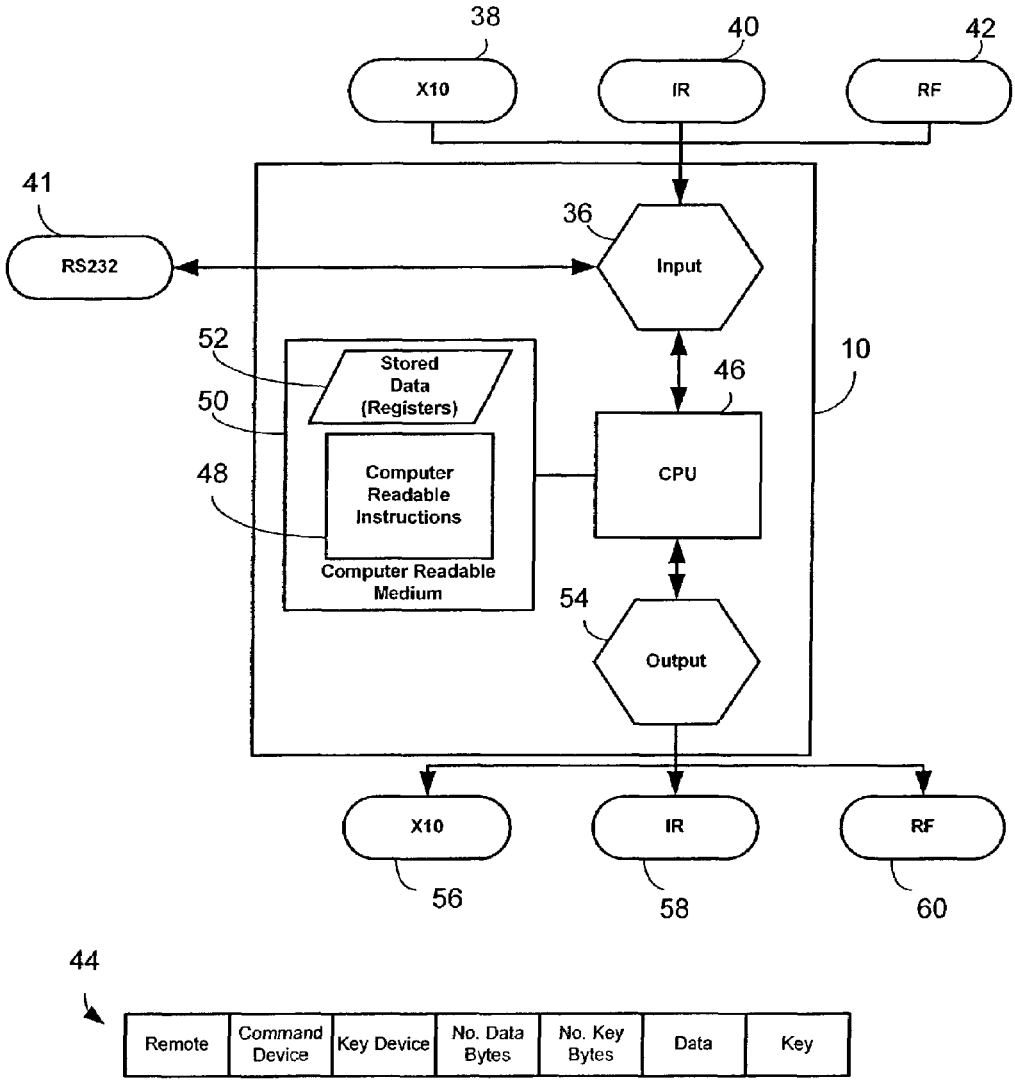
FIG. 2 is a schematic of various components of this invention.

Referring now to FIG. 2, the components of a VRP remote are described in more detail. VRP remote 10 contains an input module 36 which can carry a plurality of specific input devices such as X-10 input means 38, infrared input means 40 and radio frequency input means 42. Input module 36, may also be in communication with a communication port 41, as a means of sending and receiving information, which may include a set of commands. Communication port 41 may have a RS232 protocol. Input module 36 converts the input signal from a specific input device into a command string 44 which contains specific commands for the VRP remote. A central processing unit 46 receives the command string and through computer readable instructions 48 embodied in a computer readable medium 50, in electronic communication with CPU 46, interprets command string 44 to provide the functionality herein described. Information is stored in registers 52, also carried by computer readable medium 50, that provides for a location to store and retrieve specific information related to the functionality described herein. Once input module 36 has provided CPU 46 with command string 44, the computer readable instructions may provide output from the VRP remote. In this case, output module 54, in electronic communication with CPU 46, receives an output string and outputs an execution signal to a number of consumer electronics. These output signals can take the form of X-10 output 56, IR output 58, or RF output 60. As can be seen, any number of inputs can result in any number of outputs with the ability to translate the input signal to the output signal according to the specific device desired to be reached.

Figure 3:
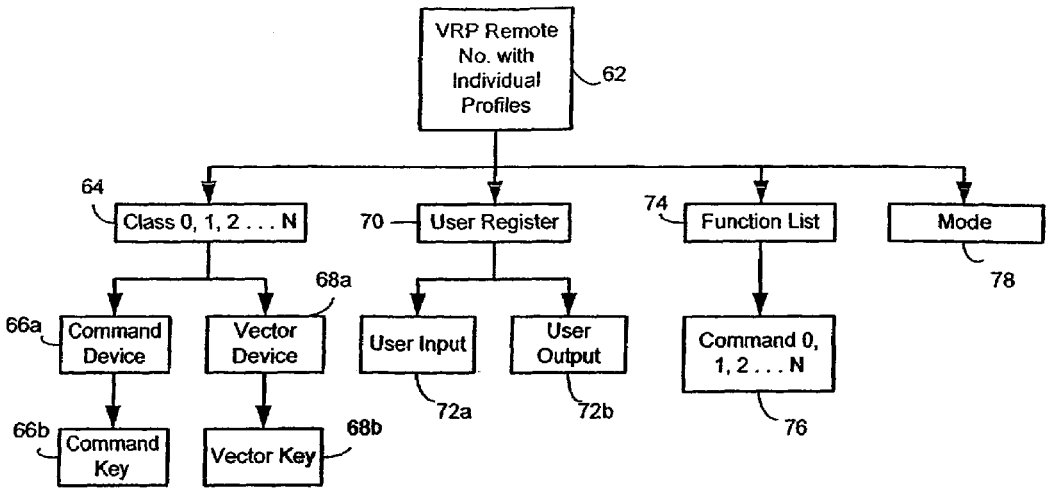
FIG. 3 is a schematic of registers of the invention.

Referring now to FIG. 3, the data stored in registers 52 is described in more detail. Here, the VRP remote number and its particular individual profile 62 is shown at the top of the data hierarchy. Each profile designates a number of classes 64 which are available for that particular VRP remote. A class may represent a particular grouping of application types such as stereos, doorbells, or pool equipment. For example, class 0 may represent stereos, class 1 represents televisions, and class 2 represents light switches. Within each particular class is a command device register 66A, and a command key register 66B. The command device identifies which particular device is emulated by the register, for example, a remote control or an X-10 wall switch. The command key represents the particular command or function performed by the particular command device such as the on/off button of a remote control. Additionally, each class may have numerous vector devices 68*a* and vector keys 68*b*. A vector device is a device for which the output from the VRP remote is to emulate. For example, a vector device may also be a remote control or X-10 wall switch. The VRP, through the vector device 66, knows what type of device to emulate and through vector key 68 knows what type of function to emulate. For example, a vector key may be the on/off switch of a particular device such as a remote control which would be designated the vector device. Therefore, the VRP remote can receive an "on" command from an X-10 wall switch, convert the command to "arm security system" and transmit the command to the security system by emulating an IR device.

Additionally, a VRP remote may have multiple user registers 70 that have storage space that can both accept the user input 72*a* as well as provide user output 72*b*. This allows for a specific user to be able to customize information passed to the VRP remote without having to change the hardware or increase storage space of a particular VRP remote. A function list 74 may be included with each VRP remote, which is a list of commands that the VRP remote can perform. The plurality of commands is shown as 76 allow for a universal method for controlling a VRP remote without the necessity of having specific programming language or protocol to the VRP remote. By having specific commands in at least one function list, it is merely necessary to select a command from the existing list so that customized or proprietary programming is not necessary to have the VRP remote perform specific activities. One needs merely to request the command needed to be performed. This allows for the VRP remote to be used across platforms and does not restrict the VRP remote to a particular command language, program language, or protocol. Also, the VRP remote can have operation mode selection 78 which can include normal operation mode, for signal and receiving between various devices, slave mode, which is having VRP remote merely make the activity of another VRP remote, or programming mode, for which the VRP remote can be instructed on how to perform its functionality.

Figure 4:
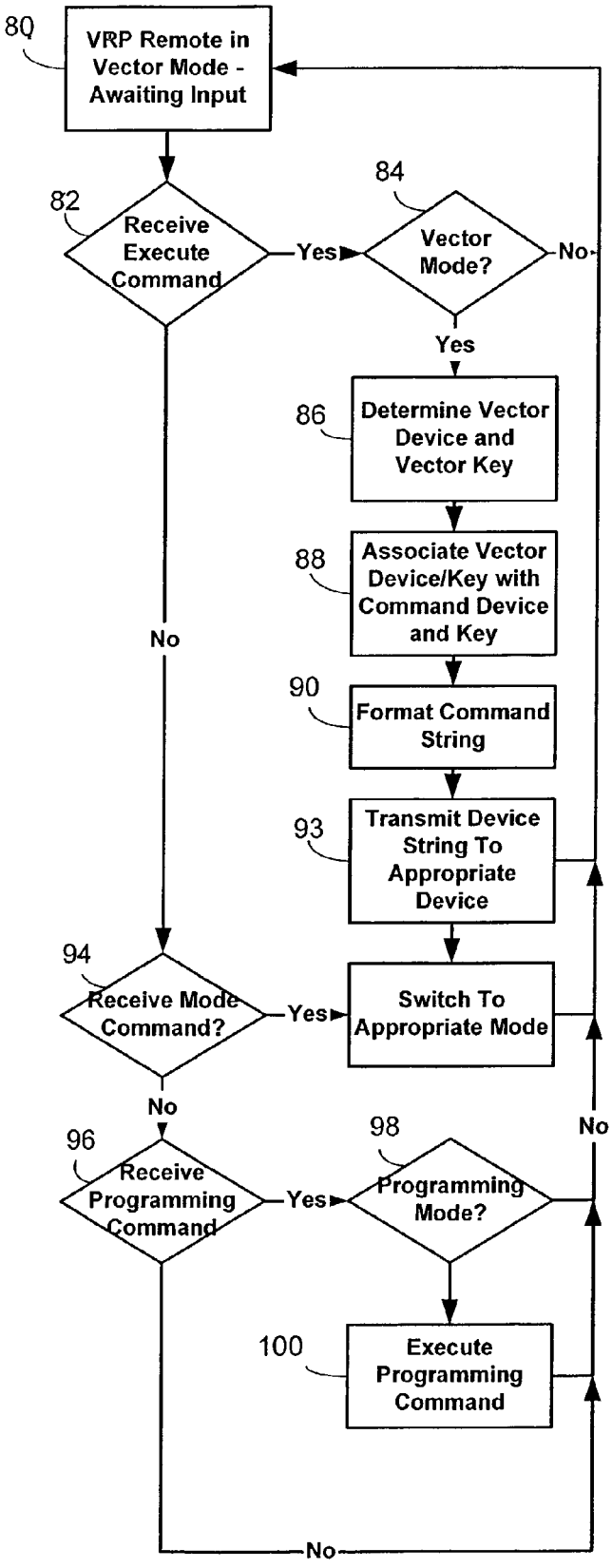
FIG. 4 is a flowchart illustrating the operation of the invention.

Referring now to FIG. 4, the VRP remote in normal operation is explained in further detail. Initially, the VRP remote is in input or vector mode, which means it is ready to receive a command, and is awaiting an input or vector in step 80. The term vector is used to describe the signal from a control device that a user wishes to have associated with a certain response. If an executed command is received in step 82, an inquiry is made in step 84 as to whether the VRP remote is in vector mode or not. If not, the VRP remote returns to awaiting input. If so, a determination is made in step 86 as to the vector device and vector key for which the VRP remote has received a signal. Once determined, the associated command device and command key associated with the vector device and vector key received, is determined in step 88. For example, the "on" of a remote control being received can be associated in the "arm" of a security system. Therefore, the "on" is the vector with "arm" being the command. The command string associated with the command device and command key is formatted in step 90 and the formatted string is transmitted to the intended device in step 93. At this point, the VRP remote awaits additional input.

If a "mode" command is received in step 94, the VRP remote is placed in the appropriate mode which can include normal operating or vector mode, programming mode, or slave mode. If a programming command is received in step 96, an inquiry in step 98 is made as to whether the VRP remote is in programming mode or not, if the VRP remote is not in programming mode, it returns to await input. However, if the VRP remote is in programming mode, the received commands are executed in step 100.

Figure 5:
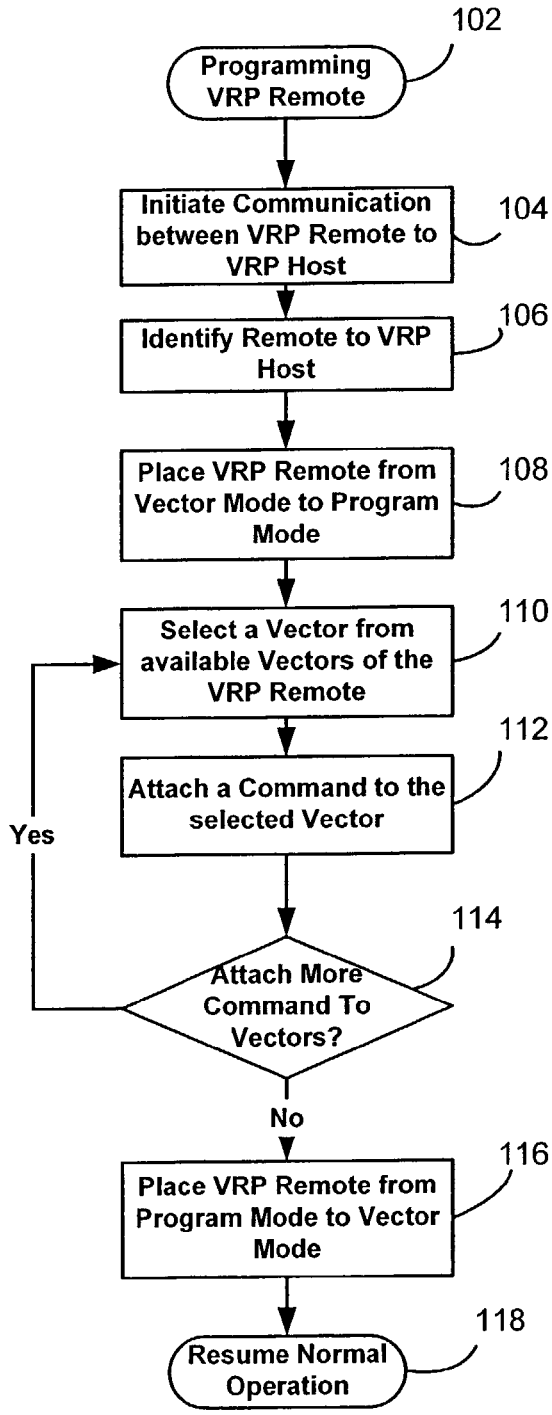
FIG. 5 is a flowchart illustrating the operation of the invention.

Referring now to FIG. 5, the programming of the VRP remote is explained in more detail. If the VRP remote is to be programmed in step 102, step 104 shows the initiation of communications between a VRP remote and VRP host 11 (in FIG. 1) in step 104. Next, step 106 shows the VRP remote being identified to the VRP host. Once identified, the VRP remote is placed in programming mode in step 108. The user selects a vector or input from those available to the VRP remote in step 110. Next, a command is attached to a specific vector in step 112 and a determination is made as to whether more commands need to be attached to more vectors in step 114. If so, we return to step 110 so as to program the next vector. Otherwise, the VRP remote is placed from program mode back to normal operations, or vector mode in step 116, and the VRP remote returns to normal operations in step 118.

Figure 6:
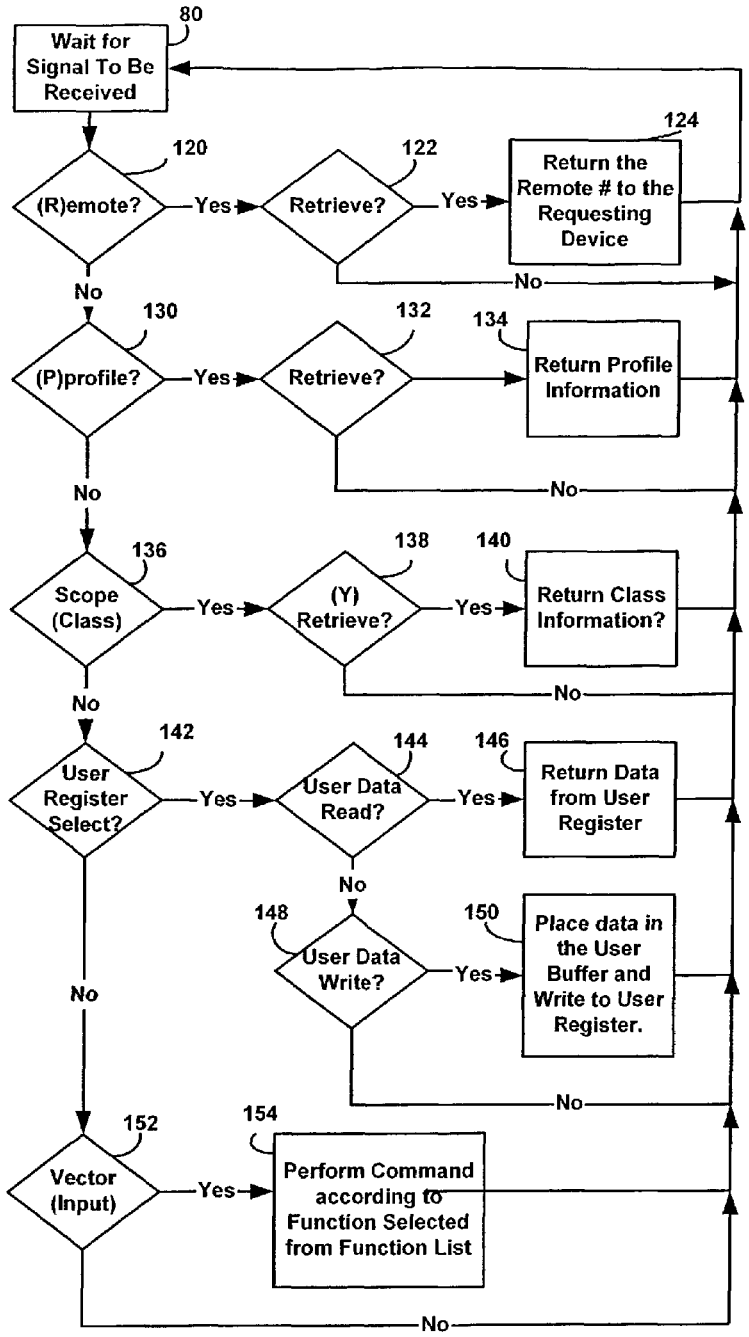
FIG. 6 is a flowchart illustrating the operation of the invention.

Referring now to FIG. 6, additional commands available to a VRP remote are further explained. When a VRP remote is awaiting a signal in step 80, a command identifying the VRP remote may be received in step 120. If so, a remote number retrieve command can be received in step 122 and the VRP remote returns the remote number to the requesting device in step 124. The VRP remote may also receive a profile command in step 130 and if such command is to retrieve the profile information in step 132, the profile information is returned to the requesting device in step 134. The VRP remote may also receive a scope or class command in step 136. If the scope or class is requested for retrieval in step 138, then the class information is returned in step 140. User data may be selected at step 142 to at which point it is determined that step 144 if the user data should be read. If so, the user data is returned from the user register in step 146. In the event that the determination is made to write data to the user register in step 148, the data is placed in the user buffer and written to the user register in step 150. When the VRP remote receives an input or vector as determined in step 152, the command is performed according to the function selected from the function list in step 154. All these functions are shown in addition to those of FIG. 4, it should be noted that they can be in succession or any combination.

Figure 7:
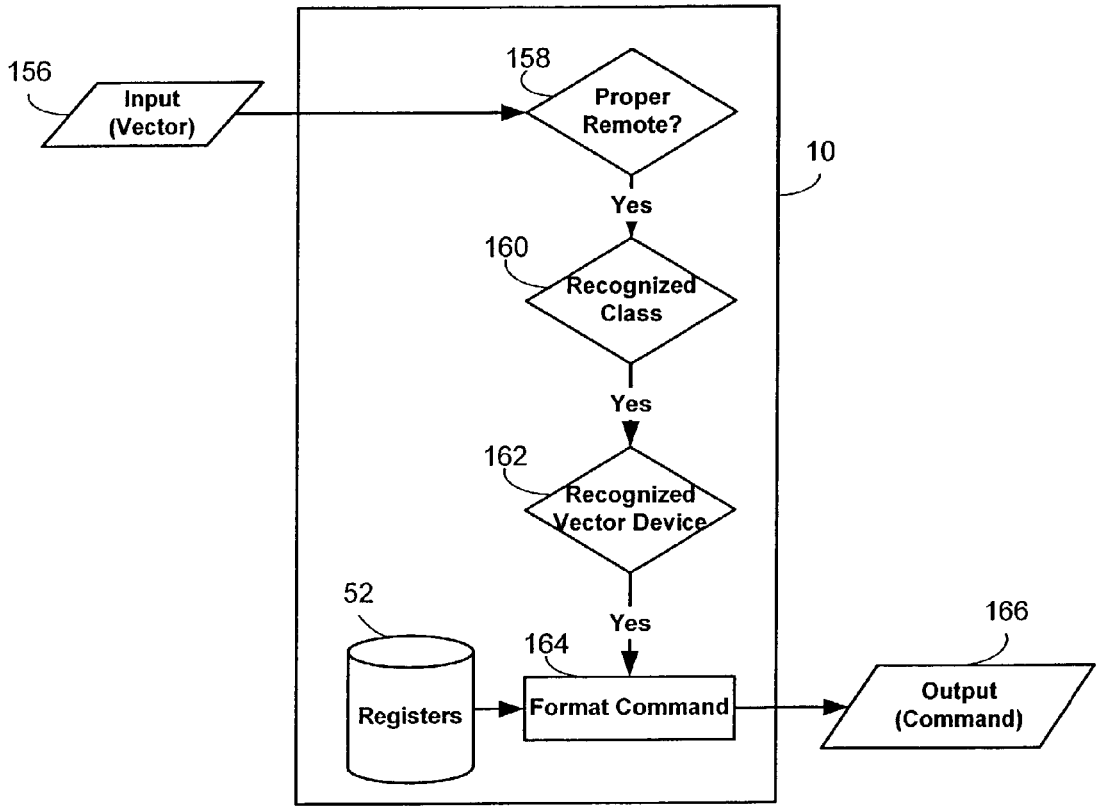
FIG. 7 is a flowchart illustrating the operation of the invention.

Referring now to FIG. 7, the common flow of this invention is illustrated in further detail. When the VRP remote 10 receives an input or vector 156, the determination is made in step 158 as to whether the command applies to this particular remote. If so, a determination is made in step 160 as to whether the command qualifies for the proper class of the VRP remote. If so, a determination is made in step 162 as to whether the input signal is of a recognized vector device for VRP remote 10. If so, an appropriate output is retrieved from registers 52 and the information is formatted into an output command in step 164 so that an output command 166 is transmitted from the VRP remote to the receiving electronic appliance. The output command can have many formats, each corresponding to the particular device that the VRP remote is attempting to control. For example, the output command can take the form of IR, RF, X-10, or other information. For example, in the IR mode format, the record contains device number, key number, key name, number of data bytes, the number of key code bytes, the actual data bytes, and the key code bytes in a record. This allows variable length information to be stored so as to economize storage space while allowing the flexibility of placing any type format into the VRP remote. For example, the same format can be used in order to format a "macro" command. This record format contains a device number, key number, key name, number of data bytes, number of key code bytes, and data bytes. It should be noted that for this particular command, the number of key code bytes is always zero and, therefore, it is unnecessary to have a key code bytes field. The macro allows for a series of commands to be executed from one vector input so as to have a multi-function VRP remote. For example, pressing the on button of an IR remote can transmit an on signal to the VRP remote which can in turn transmit on signals to a lamp, a stereo, and a CD player. Therefore, merely pressing one button on a traditional IR remote allows for a multitude of consumer electronics to be turned on. Similar formats can be made for RF and X-10 as well as other formats required for the particular electronic consumer device connected to the VRP remote.

Figure 8:
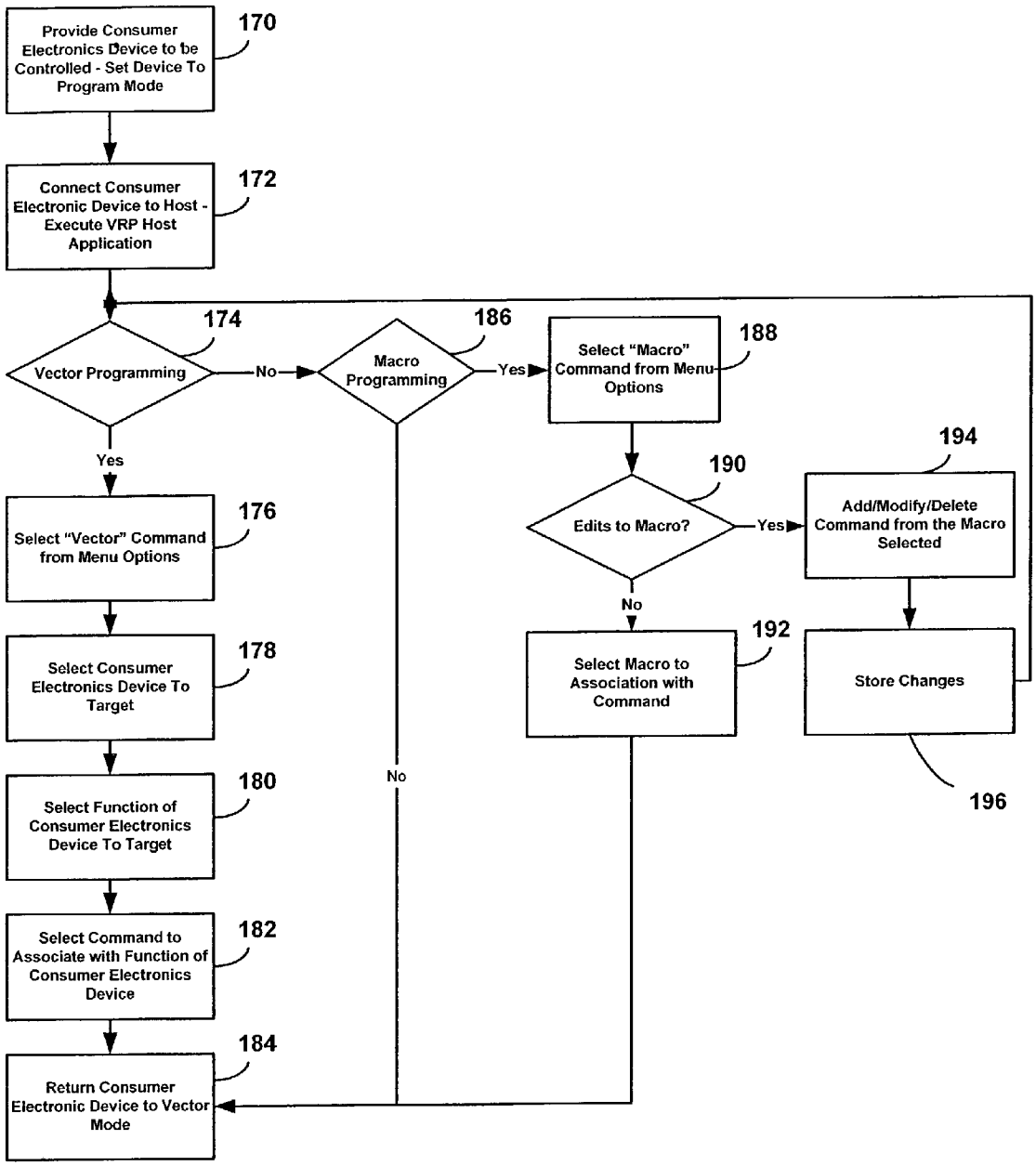
FIG. 8 is a flowchart illustrating the operation of the invention.

Referring now to FIG. 8, the VRP host is described in more detail. The VRP host is a set of computer readable instructions embodied in a computer readable medium that provides the ability to "program" the VRP remote so as to provide the functionality described herein. Step 170 shows that the VRP remote is selected for programming and placed in program mode. In step 172, the VRP host application is executed and the VRP remote is connected to the VRP host. The determination is made whether to enter vector programming in step 174. If so, a vector command is selected from the menu options of the VRP host in step 176. The particular targeted electronic device is selected in step 178. The function of the electronic device is selected in step 180. The command to be associated with the function of the electronic device is associated with the VRP remote in step 182 and the VRP remote is returned to vector mode in step 184, thereby completing the process that allows the VRP remote to perform the functionality of the particular consumer electronic device. In step 174, the determination may not have been made to enter vector programming. If not, then the determination of whether to be involved with macro programming is made in step 186. If so, then the macro command is selected from the menu options of the VRP host in step 188. If edits to the macro are to be made in step 190, then modifications, deletions, or additions to a macro can be made in step 194. These changes are stored in step 196, and the application returns to determining whether to perform vector programming in step 174. If edits to the macro were not to be made, then the macro associated with the particular VRP remote command in step 192 and then the VRP remote is returned to vector mode in step 184.

While a preferred embodiment of the invention has been described using specific terms, such description is for illustrative purposes only, and it is to be understood that changes and variations may be made without departing from the spirit or scope of the following claims.

What is claimed is:

1. A system for controlling at least one electronic device responsive to a first protocol according to at least one controlling device generating an input signal having a second protocol comprising:

a housing;

a computer readable medium contained within said housing;

an input means contained within said housing and in communications with said computer readable medium for receiving said input signal from said at least one controlling device;

an output means contained within said housing and in communications with said computer readable medium for outputting an output signal to said at least one electronic device, using said first protocol;

a set of computer readable protocol instructions embodied within said computer readable medium for associating said input signal having said second protocol with said output signal having said first protocol; and a set of computer readable command instructions embodied within said computer readable medium for:

receiving said input signal having said second protocol from said at least one controlling device using said input means;

generating said output signal having said first protocol to said at least one electronic device according to said input signal and said set of protocol instructions;

transmitting said output signal using said output means to said at least one electronic device so that said controlling device controls said at least one electronic device without said controlling device having to use the same protocol as said electronic device; and, receiving a validation signal as to whether said output signal reached said electronic device.

2. The system of claim 1 wherein said input signal is X-10.

3. The system of claim 1 wherein said input signal is infrared.

4. The system of claim 1 wherein said input signal is radio frequency.

5. The system of claim 1 wherein said set of protocol instructions include instructions for:

identifying said at least one controlling device according to said input signal, identifying a key command according to said input signal, and, generating said output signal according to said at least one controlling device and said key command.

6. A system for controlling at least one electronic device responsive to a first protocol according to a command device generating an input signal having a second protocol comprising:

a computer readable medium;

an input means in communication with said computer readable medium for receiving said input signal from said command device;

an output means in communication with said computer readable medium for outputting an output signal having a first protocol to said at least one electronic device;

a set of actuating information embodied within said computer readable medium representing at least one output command to said at least one electronic device;

a set of command device information embodied within said computer readable medium representing at least one command device, said command device information containing at least one specific command associated with said command device and associated with said at least one output command;

a set of computer readable instructions embodied within said computer readable medium for receiving an input signal from said command device, determining said at least one specific command contained within said input signal, retrieving at least one output command associated with said at least one specific command from said set of actuating information, and transmitting said at least one output command to the electronic device through said output means, and receiving a validation signal as to whether said output signal reached said electronic device.

7. The system of claim 6 wherein said output signal is radio frequency.

8. The system of claim 6 wherein said set of computer readable instructions include instructions for formatting said at least one output command prior to transmitting said at least one output command to said at least one electronic device.

9. The system of claim 6 wherein said output signal is X-10.

10. The system of claim 6 wherein said output signal is infrared.

11. A system for controlling at least one electronic device being responsive to a first protocol according to a command device generating an input signal having a second protocol comprising:

a computer readable medium;

an input means in communication with said computer readable medium for receiving an input signal from said command device;

a set of registers contained within said computer readable medium for storing register information having input signal information, output signal information, and associational information for associating said input signal information with said output signal information;

an output means in communication with said computer readable medium for outputting output signal information to said at least on electronic device; and, a set of computer readable instructions embodied within said computer readable medium for receiving said input signal information from said command device having said second protocol through said input means and outputting said associated output signal information through said output means to said at least one electronic device so that said electronic device can be actuated by said command device regardless of differing protocols, and including validation instructions for receiving a validation signal from said at least one electronic device as to whether said output signal information reached said at least on electronic device.

12. The system of claim 11 wherein said output signal information includes a radio frequency protocol.

13. The system of claim 11 wherein said set of computer readable instructions include instructions for formatting said output signal information prior to outputting said output signal information to said at least one electronic device.

14. The system of claim 11 wherein said output signal information includes an X-10 protocol.

15. The system of claim 11 wherein said output signal information includes an infrared protocol.

* * * * *